United States Patent [19]

Liberto et al.

[11] 4,349,148

[45] Sep. 14, 1982

[54] EMERGENCY HEATING SYSTEM CONTROL CIRCUIT

[76] Inventors: Samuel J. Liberto, 429 Parker St.; James Meli, 6981 Verona St., both of Verona, Pa. 15147

[21] Appl. No.: 236,797

[22] Filed: Feb. 23, 1981

[51] Int. Cl.[3] ..... H02J 7/00; F24D 5/10

[52] U.S. Cl. ..... 236/11; 307/66

[58] Field of Search ..... 307/66; 236/10, 11

[56] References Cited

U.S. PATENT DOCUMENTS 4,129,811 12/1978 Pearson ..... 307/66 X 4,242,078 12/1980 Nelson et al. ..... 307/66 X 4,249,696 2/1981 Donnelly et al. ..... 307/66 X

*Primary Examiner*—William E. Wayner

*Attorney, Agent, or Firm*—Harold A. Williamson

[57] ABSTRACT

This invention relates to a DC powered emergency heating system control circuit for use in combination with a gas furnace that includes an AC power supply for a thermostat to control a normally operated AC powered automatic gas valve, which gas valve provides gas for burning in a plenum chamber. The control circuit includes an auxiliary fan and circuits responsive to the interruption of AC power to provide in a repetitive sequence, DC power pulses of one polarity to the automatic gas valve, followed by energization of the auxiliary fan, followed by the application of DC power of an opposite polarity to the gas valve. This repetitive sequence thereby ensures alternate periods of convection and auxiliary fan induced forced air heating while simultaneously protecting the normally AC powered gas valve from the deleterious magnetism effect brought on by the continuous emergency DC powered operation of the gas valve.

7 Claims, 4 Drawing Figures

EMERGENCY HEATING SYSTEM CONTROL CIRCUIT

Figure 1:
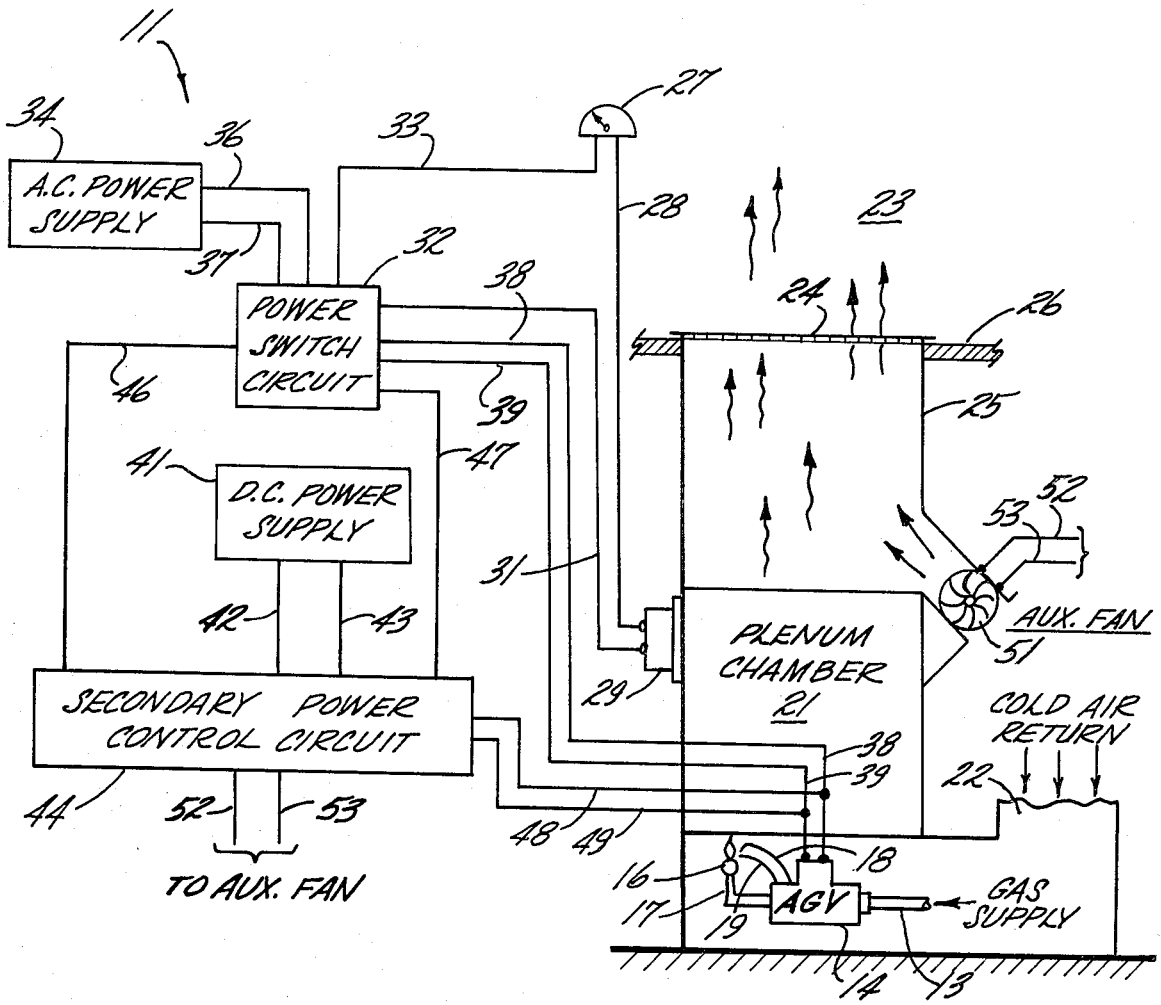

This invention relates to an emergency heating system control circuit.

More specifically this invention relates to a DC powered emergency heating system control circuit for use in combination with a gas furnace that includes an AC power supply for a thermostat to control a normally operated AC powered automatic gas valve, which gas valve provides gas for burning in a plenum chamber. The control circuit includes an auxiliary fan and circuits responsive to the interruption of AC power to provide in a repetitive sequence, DC power pulses of one polarity to the automatic gas valve, followed by energization of the auxiliary fan, followed by the application of DC power of an opposite polarity to the gas valve. This repetitive sequence thereby ensures alternate periods of convection and auxiliary fan induced forced air heating while simultaneously protecting the normally AC powered gas valve from the deleterious magnetism effect brought on by the continuous emergency DC powered operation of the gas valve.

The energy crisis that besets the world today has spawned a multitude of problems not the least of which has been the increasing occurrence of power outages. Some of the power outages come from simply an overtaxed electrical distribution system. A more alarming type of power outage is of the type where utility companies short on energy are selectively rotating power outages amongst their customers in order to accomplish the necessary electrical energy conservation. While power outages are not new, their increasing frequency and the extensiveness of the duration has caused alarm and dismay to those homeowners in the northern latitudes whose homes are heated by gas. The greater bulk of homes with gas heat have as part of their furnace heating systems automatic gas valves that respond to power outages by shutting the primary flow of gas to be burned in a plenum chamber of the furnace. The power outage causes these automatic gas valves to turn off while leaving a small pilot light burning. The absence of power of course also prevents the gas furnace's fan which force air through the system from operating.

There are a countless number of older homes which are poorly insulated and inhabited by individuals who are in their advancing years. These older homes and their inhabitants are especially distressed by falling temperatures within their homes. For many it is a panic situation, one in which they are powerless to supplement the supply of heating to their home during these outages. It is to the need created by this panic that the invention to be described provides a unique and simple solution while simultaneously maintaining all the inherent safety features of existing heating systems.

It is therefore an object of this invention to provide an emergency heating control circuit for use in gas fired furnaces that employ electrically automatic gas supply valves.

Another object of this invention is to provide a gas furnace heat control system with a secondary power source that will allow for the provision of alternate periods of convection and auxiliary fan induced forced air heating in a home, upon loss of power in a heating system that would normally provide forced hot air through the heating system.

Still another object of this invention is the creation of a simple and easily manufactured emergency control circuit for use with any gas heating furnace that employes an automatic gas supply valve, which control circuit is inherently safe in its operation and readily attached to an existing heating system.

In the attainment of the foregoing objects, the invention provides an emergency heating system control circuit for use in combination with a gas furnace that includes a primary AC power supply for a thermostat to control an electrically operated automatic gas valve, which gas valve provides gas for burning in a plenum chamber. The control circuit includes amongst other components a secondary DC power supply. A power switching unit is controllably coupled to a secondary power control circuit. The secondary power control circuit is electrically coupled to the secondary DC power supply, as well as, the automatic gas valve and auxiliary fan. The power switching unit provides electrical power from the primary AC power supply to the automatic gas valve and to the thermostat as long as the primary power supply remains uninterrupted.

The secondary power control circuit controls the secondary DC power supply in a manner such that the automatic gas valve first receives power of one polarity followed by the auxiliary fan being energized and thereafter the automatic gas valve receiving power of an opposite polarity, whereupon the sequence of automatic gas valve and auxiliary fan operation repeats itself. The power switching unit upon detection of an interruption of power from the primary AC power supply provides an electrical connection between the secondary power control circuit, the secondary DC power supply, as well as, the automatic gas valve and the auxiliary fan to thereby allow the gas furnace in a power interruption emergency to provide alternate periods of convection and forced air heating.

The secondary power control circuit is characterized by the inclusion of a clock or timing unit and a logic circuit. The timing unit provides a sequential series of signals to the logic circuit. The logic circuit in turn has outputs that operate to controllably couple the secondary DC power supply to the automatic gas valve and the auxiliary fan.

The invention further contemplates that the thermostat be connected in series to a high temperature limit switch responsive to the plenum chamber temperature. The thermostat and high temperature limit switch are controllably connected to the automatic gas valve and the secondary power control circuit by the power switching unit to thereby ensure automatic gas valve turn off should there be a secondary power control circuit failure which allows the automatic gas valve to remain open.

In the preferred embodiment of the invention, the auxiliary fan is positioned in the heating system to direct the movement of convection heated air. The secondary DC power supply is typically a battery.

Finally, the invention contemplates that power switching unit will include a relay that is normally energized by the AC power supply. The relay includes a trio of switches having a pair of front contacts, which pair of front contracts are normally electrically connected respectively to the AC power supply, the thermostat, as well as, the high temperature limit switch and the automatic gas valve. The relay's trio of switches further includes a trio of back contacts which become operative when the AC power supply is interrupted. Upon power interruption, the trio of switches complete circuits over the aforementioned back contacts respectively to the thermostat, the high temperature limit switch, the secondary power control circuit and the automatic gas valve.

Figure 2:
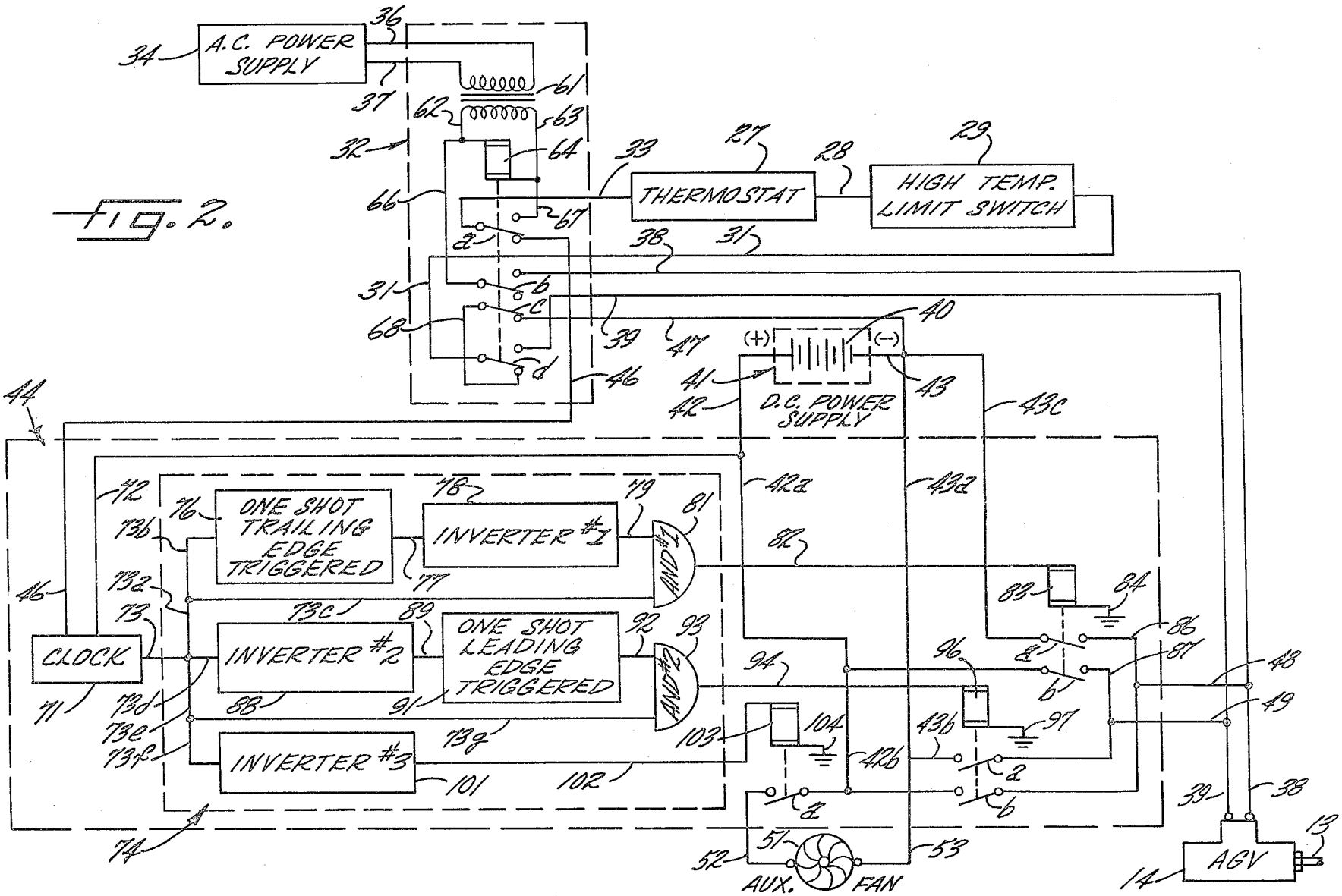
Figure 3:
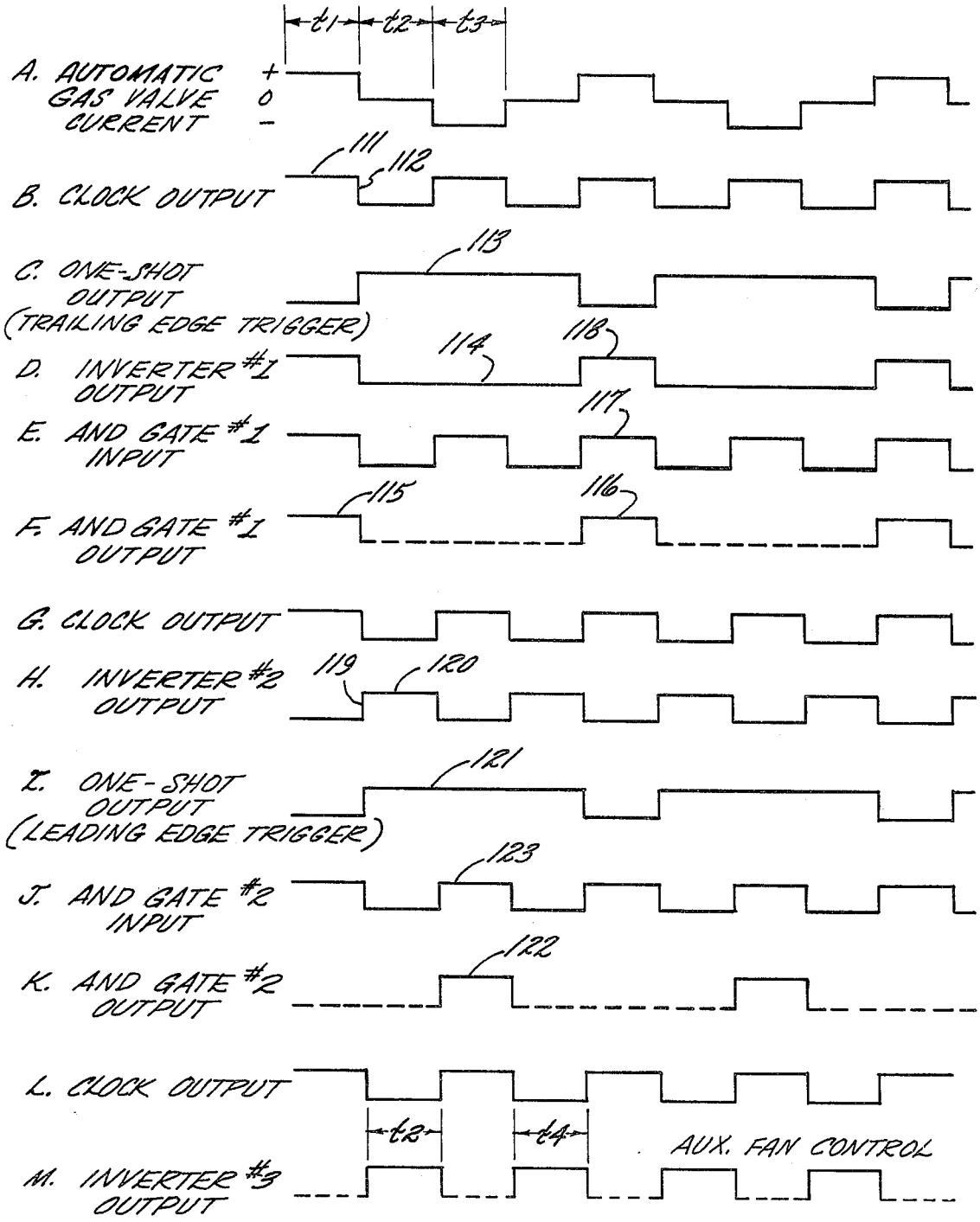
Figure 4:
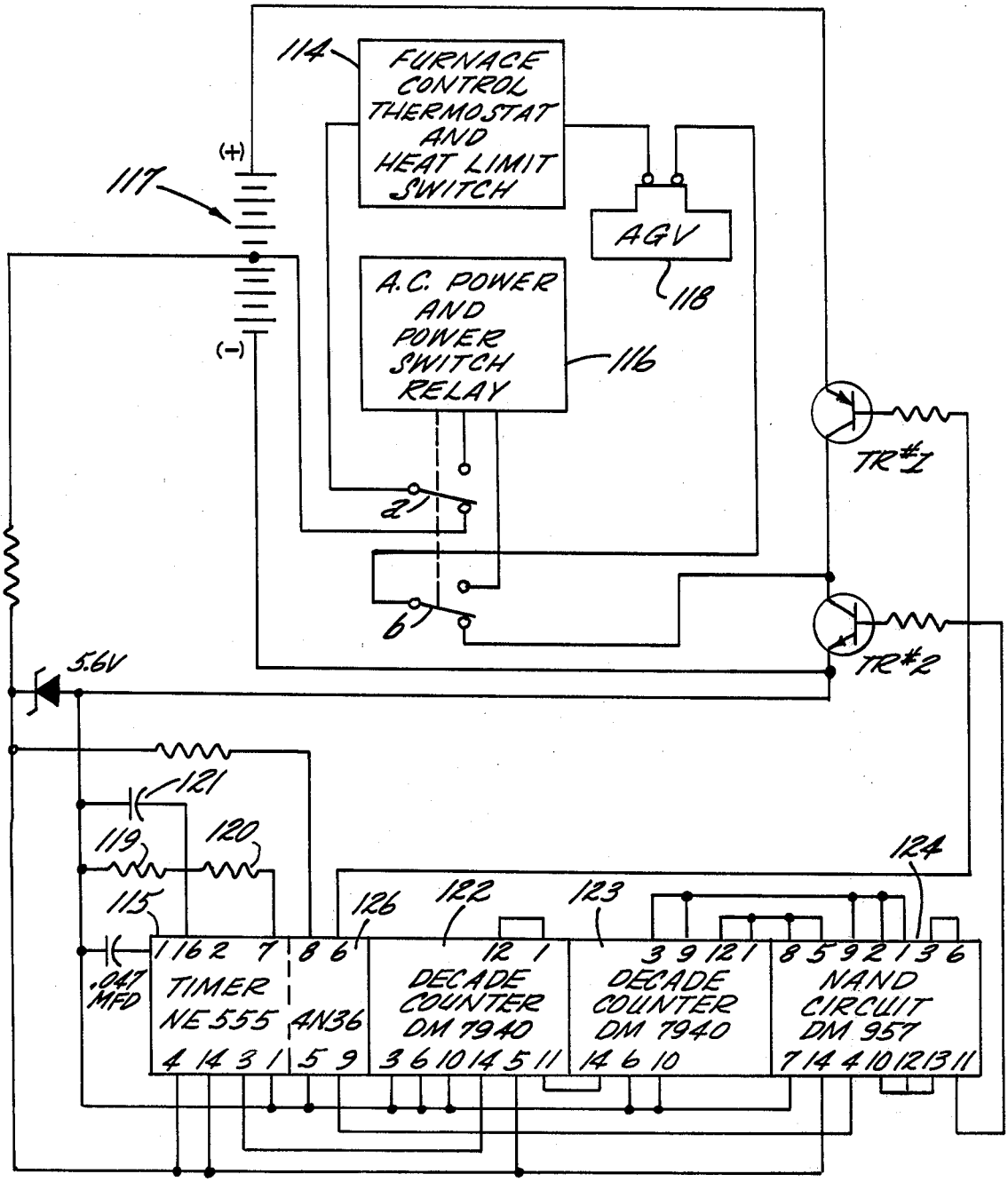

Other objects and advantages of the present invention will become apparent from the ensuring description of illustrative embodiments thereof, in the course of which reference is made to the accompanying drawings in which:

FIG. 1 illustrates in block diagram form the invention in functional co-operation with a heating system, FIG. 2 illustrates a preferred embodiment of this invention and shows in greater detail the nature of the electrical components and co-operative interrelation of the heating system, FIG. 3 is a timing chart of signals present in the electrical arrangement of FIG. 2, and FIG. 4 depicts another timing circuit arrangement suitable for use in practicing the invention.

Reference is now made to FIG. 1 which shows in block diagram form the invention embodied in the emergency heating system control circuit 1. In a highly schematic form there is shown a gas fired furnace 12. The furnace 12 is conventional is that it includes a gas supply shown delivered via pipe 13 to an automatic gas valve (AGV) 14. A burner nozzle 16 is connected by pipe 17 to the AGV 14. A pilot light line 18 and thermacouple sensor 19 are also connected to the AGV 14 and operate in a conventional manner. The burner nozzle 16 provides a flame that heats a plenum chamber 21 or heat exchanger as it is sometimes referred to. A main fan, not shown, is conventionally positioned beneath the plenum chamber 21 and draws air from a cold air return 22 of dwelling. The main fan delivers cool air past the plenum chamber where it is heated and thereafter delivered to the room 23 through a register 24 in the floor 26. A thermostat 27 is connected in series by lead 28 to a high temperature limit switch 29 mounted on the plenum chamber 21, through lead 31 power switch circuit 32 and back via lead 33 to the thermostat 27. An AC power supply 34 is connected via leads 36, 37 to the power switch circuit 32. The AC power supply 34 is of a conventional househould current and voltage type. The automatic gas valve is connected via leads 38, 39 to the power switch circuit 32.

The conventional household heating system includes the AC power supply 34, the power switch circuit 32 that includes a transformer to be described hereinafter, a thermostat 27, high temperature limit switch 29 and the AGV 14. The invention to be described more fully hereinafter further includes a DC power supply 41 provides a secondary power source which is electrically coupled to a secondary power control circuit 44. The secondary power control circuit 44 is electrically connected to the power switch circuit 32 by leads 46, 47 and by leads 48, 49 to leads 38, 39 of the AGV 14. An auxiliary fan 51 mounted in the heated air duct 25 is also electrically connected to the secondary power control circuit 44 via leads 52, 53.

As was noted earlier the gas furnace 12 normally has an AC power supply 34 for a thermostat 27 to control a normally operated AC powered AGV 14. The AGV provides gas for burning at a nozzle 16 in or near a plenum chamber 21. The control circuit of the invention includes an auxiliary fan 51 and circuits, such as power switch circuit 32 and secondary power control circuit 44 which circuits are responsive to the interruption of AC power to provide a repetitive sequence DC power pulse of one polarity to the automatic gas valve, followed by energization of the auxiliary fan 51, followed by the application of a DC power pulse of an opposite polarity to the gas valve. This repetitive sequence of pulses and auxiliary fan energization ensures periods of convection and auxiliary fan 51 induced force air heating while simultaneously protecting the normally AC power gas valve from the deleterious effect of continuous emergency DC power operation of the AGV 14.

Reference is now made to FIG. 2 which depicts a preferred embodiment of the invention and shows in greater detail the nature of the electrical components and co-operative interrelationship of the emergency heating system control circuit of the heating system. It will be noted that in FIG. 2 the power switching circuit 32, the DC power supply 41 and the secondary power control circuit 44 of FIG. 1 are shown in dotted outline.

The power switching circuit of FIG. 2 is shown to include a transformer 61 electrically coupled to the AC power supply 34 via electrical leads 36, 37. The other side of the transformer 61 has a power switch relay 64 electrically coupled thereto by leads 62, 63. The AC power supply 34 is that of a normal household supply. The transformer 61 is a step down transformer that reduces the voltage of the power furnished to operate the power switch relay 64 and as will be explained hereinafter in the AGV 14. The power switch relay 64 has contactors a, b, c and d.

In a normal, non-emergency mode of operation, AC power having a stepped down voltage is provided respectively to contactor b of power switch relay 64 via lead 66 from lead 62 of transformer 61 and front contact a of power switch relay 64 via lead 67 from 63 of transformer 61. The energization of power switch relay 64 causes the contactors a through d to pick up and complete a power supply circuit for the heating system controls. The circuit begins with lead 62 from transformer 61 and is completed via lead 66, front contact b of power switch relay 64, lead 38, AGV 14, lead 39, front contact d of power switch relay 64, lead 31, high temperature limit switch 29, lead 28, thermostat 27, lead 33, front contact a of power switch relay 64 and finally lead 67 to lead 63 of the transformer 61. The circuit just described would allow normal operation of the heating system.

Upon the interruption of AC power, the power switch relay 64 will become de-energized and a set of circuits will be completed over back contacts a, c and d of power switch relay 64. Before this set of circuits will be described, a brief explanation in respect of the components in the secondary power control circuit 44 wil be set forth.

A clock pulse generator 71 that provides a train of pulses of set duration is electrically connected to logic circuit 74, shown in dotted outline. The clock 71 or timer as it may be referred to can be any of a number of commercially available units. The details of the clock pulse generator 71 form no part of the invention.

The clock pulse generator 71 where energized delivers a train of pulses on lead 73 to a trailing edge triggered one shot multivibrator 76 via leads 73*a*, 73*b*. The train of pulses from the clock pulse generator 71 is simultaneously delivered to No. 1 AND gate 81 via leads 73*a*, 73*c*. The oneshot multivibrator is electrically coupled to the No. 1 AND gate 81 via lead 77, No. 1 inverter 79 and lead 79. The No. 1 AND gate 81 has an output signal delivered to a logic relay 83 via lead 82. The logic relay 83 is connected by lead 84 to ground as shown. The logic relay 83 has a pair of contactors a and b.

The clock pulse generator 71 when energized also delivers a train of pulses on lead 73 to a No. 2 inverter 88 via lead 73*d*. The train of pulses from the clock pulse generator 71 is simultaneously delivered to No. 2 AND gate 93 via leads 73*e*, 73*g*. The No. 2 inverter 88 is electrically coupled to the No. 2 AND gate 93 via lead 89, leading edge triggered one shot multivibrator 91 and lead 92. The No. 2 AND gate 93 has an output signal delivered to a logic relay 96 via lead 94. The logic relay 96 is connected by lead 97 to ground as shown. The logic relay 96 has a pair of contactors a and b.

Finally, the clock pulse generator 71 when energized also delivers a train of pulses on leads 72, 73*e* and 73*f* to No. 3 inverter 101, which in turn is electrically connected to auxiliary fan relay 103 via lead 102. Auxiliary fan relay 103 is connected by lead 104 to ground as shown.

The operation of the logic circuit 74 will be explained and be more readily understood when the pulse timing chart of FIG. 3 is set forth in detail hereinafter.

The clock pulse generator 71 is continuously energized from the DC power 41 whenever there is a power interruption that results in a de-energization of power switch relay 64. A battery 40 which forms the secondary power supply 41 is connected across the clock pulse generator 71 by a circuit that can be described as beginning with the positive terminal of the battery 40, leads 42, 72, clock 71, lead 46, back contact a of power switch relay 64, lead 33, thermostat 27, lead 28, high temperature limit switch 29, lead 31, back contact d of power switch relay 64, lead 68, back contact c of power switch relay 64, leads 47, 43 and finally to the negative terminal of battery 40. It is important to the invention to note that the circuit that includes the clock pulse generator 71 has connected in series the high temperature limit switch 29 which ensures that the secondary power supply 41 will be disconnected from supplying power to the secondary powser control circuit 44 should for any reason the plenum chamber be over heated to a point where the high temperature limit switch 29 is opened.

Before describing the dynamics of the logic circuit 74 and the remainder of the components in the secondary power control circuit 44, a brief explanation of how the AGV 14 is first energized with a secondary power supply 41 of one polarity and thereafter is energized by the secondary power supply 41 of an opposite polarity.

Attention is directed to logic relay 83 and the manner in which it electrically connects the battery 40 and the secondary power supply 41 to the AGV 14. Whenever logic relay 83 is energized a circuit is completed from the positive terminal of the battery 40 over leads 42, 42*a* front contact b of logic relay 83, leads 87, 49, 39 to the AGV 14. The circuit continues from the AGV 14 via leads 38, 48, 86 front contact a of logic relay 83, leads 43*c*, 43 to the negative terminal of the battery 40. The just described circuit provides the AGV 14 with lead 39 in a more positive state than lead 38.

The auxiliary fan is powered with DC power from battery 40 whenever both logic relays 83 and 96 are de-energized and the auxiliary fan relay 103 is energized. With auxiliary fan relay 103 energized, a circuit is completed from the positive battery terminal of battery 40 via leads 42, 42*a*, 42*b*, 106, front contact a of auxiliary fan relay 103, lead 52 through auxiliary fan 51, to leads 53, 43*a*, 43 to the negative terminal of battery 40.

The clock pulse generator 71 and the logic circuit 74 co-operate to provide the sequential operation of logic relay 83, auxiliary fan relay 103 followed by the operation of logic relay 96.

The polarization and time duration of current flow through the AGV 14 can best be appreciated by a study of FIG. 3 at line A thereof. The sequence illustrated is intended to convey the idea that for a time period 6, the current present in the AGV 14 has a positive nature, thereafter for the time period $t_2$ there is no power delivered to the AGV 14, followed by a time period $t_3$ where the polarity is opposite that of time period $t_1$. In the preferred embodiment, the time periods have been set such that each time period t has a duration of 140 seconds.

Time M of FIG. 3 depicts a series of pulses that represent the on time periods for the auxiliary fan 51. It can be seen that during time period $t_2$ and $t_4$, etc., the auxiliary fan has been turned on and that these time periods $t_1$, $t_4$, etc., occur during the time no power is being delivered to AGV 14 as evidenced on line A of FIG. 3.

It is to be understood that for purposes of graphically explaining the operation, all the time periods have been selected a multiples of each other and that in the actual practice of the invention the AGV 14 operation may be set for shorter or longer periods of operation. The same would be true for the operation of the auxiliary fan.

With the foregoing in mind, a review of FIG. 3 made in conjunction with the circuits of FIG. 2 will now commence.

At line B there is shown the clock pulse train delivered by clock pulse generator 71. The clock pulse train is delivered simultaneously to trailing edge one shot multivibrator 76 and No. 1 AND gate 81. At the end in time of the first clock pulse 111, the trailing edge 112 of the clock pulse 111 triggers to an "ON" condition the one shot 76 and there appears on lead 77 of the logic circuit 74 a pulse 113 of the wave form shown. The No. 1 inverter 78 that receives pulse 113 provides the output condition 114 shown on line D, which condition is present on lead 79 connected to No. 1 AND gate 81. At line E it can be seen that the clock pulse sequence of line B is delivered via leads 73, 73*a* and 73*c* to No. 1 AND gate 81.

At line F the No. 1 AND gate output pulses 115, 116 are shown which logically appears each time the No. 1 AND gate 81 is presented simultaneously with a pair of positive going pulses. For example, note that directly above pulse 116 of line F the No. 1 AND gate has present thereat pulse 117 and 118. The No. 1 AND gate 81 output pulses 115, 116 are delivered to logic relay 83 and use its energization which causes the secondary power source to provide DC power of the polarity to AGV 14 in the manner described earlier.

At line G the clock pulse train shown on lines B and E is repeated to ease the explanation of that portion of the logic circuit 74 that controls the operation of logic relay 96. The No. 2 inverter 88 receives the clock pulse train of line G and provides in lead 89 the inverted pulse train shown on line H. The inverted pulse train of line H is delivered to the leading edge triggered one shot multivibrator 91 which responds to the leading edge 119 of inverter output pulse 120 and the one shot provides the pulse 121 as shown lead 92 to the No. 2 AND gate 93. The No. 2 AND gate 93 has as its other input on lead 73*g*, the clock pulse train of line J. The No. 2 AND gate 93 provides an output signal 172 on lead 94 to the logic relay 96 wherever, for example, there are simultaneously present positive going pulses 123, 121 present to the No. 2 AND gate 93 on leads 92 and 73g. The appearance of pulse signal 122 on lead 94 to logic relay 96 causes its energization which causes the secondary power source to provide DC power of an opposite polarity to AGV 14, all in the manner described earlier.

Reference is now made to FIG. 4 which depicts a typical timing circuit arrangement employing readily available electronic components.

In this specific example the AC power and power switch relay 116 normally provide AC power at 24 volts. The secondary power supply is in the form of a 12 volt battery 117. The battery 117 is shown center tapped. Because of the inherent voltage drop across the AGV 118, there will be a voltage applied across the AGV 118 of between 5 and 5.5 volts DC.

The chip NE555 is a timer 115 connected to operate as a 50% duty cycle oscillator. The 50% duty cycle is set by 8 meg ohm resistor 119 and 4 meg ohm resistor 120. The frequency of oscillation is set by resistors 119, 120 and 1 mfd capacitor 121. The output marked "3" of the timer 115 is connected to the input "14" of decade counter 122 (DM7490). The output "11" of decade counter 122 is connected to input "14" of decade counter 123. The binary outputs of decade counter 123 are connected to a series of two input NAND circuits 124. The NAND circuit 124 outputs provide the pulse train to control transistors TR1 and TR2 as shown. The NAND circuit 123 has an output "4" connected as shown to 4N36 which controls TR1. The NAND circuit 123 output "11" controls transistor TR2 directly.

In operation, the time 115 sends a signal to the base of the transistors TR1 and TR2 via the decade counters 122, 123, the NAND circuit 124 and N436 photo diode transistor 126.

Once the NAND circuit 124 output 4 goes to its low state, the photo diode transistor 126 conducts. Transistor TR1 emitter to base current flows through the photo diode transistor. Transistor TR1 emitter to collector current then flows over back contact b of AC power and switch relay 116 through the AGV 118, furnace control 114 back contact a of AC power and switch relay 116 to a mid-terminal of battery 117. When a preset time "t", such as shown at line A in FIG. 3 as time $t_1$ expires, NAND circuit 124 output "4" goes to its high state and transistor TR1 stops conducting. Current flow through the valve ceases until time $t_2$ (FIG. 3) expires at which time the NAND circuit 124 output 11 goes to its high state. With NAND circuit 124 and its output 11 in a high state, the transistor TR2 base to emitter current flows. This causes the current to flow through the AGV 118 in the opposite direction.

The resistor 119 set at 8 meg ohns and the resistor 120 set at 4 meg ohns with the capacitor 121 set at 1 microfarad will provide a 50% duty cycle where the preset time "t" is equal to 140 seconds. Increasing the valve of capacitor 121 will increase the time period "t" and conversely decreasing the valve of the capacitor 121 will decrease the time period. The transistors TR1 and TR2 can be replaced with reed relays if the full 6 volt battery voltage should be required to operate this valve.

Although this invention has been illustrated and described in connection with the particular embodiments illustrated, it will be apparent to those skilled in the art that various change may be made therein without departing from the spirit of the invention as set forth in the appended claims.

I claim:

1. A DC power emergency heating system control circuit for use in combination with a gas furnace that includes an AC power supply for a thermostat to control a normally operated AC powered automatic gas valve, which gas valve provides gas for burning in a plenum chamber, said control circuit including an auxiliary fan and means responsive to the interruption of AC power to provide in a repetitive sequence DC power of one polarity to said automatic gas valve, followed by energization of said auxiliary fan, followed by DC power of opposite polarity to said automatic gas valve, said repetitive sequence thereby ensuring alternate periods of convection and auxiliary fan induced forced air heating while simultaneously protecting said AC powered automatic gas valve from the deleterious effect of emergency DC powered operation of said normally operated AC powered gas valve.

2. An emergency heating system control circuit for use in combination with a gas furnace that includes a primary AC power supply for a thermostat to control an electrically operated automatic gas valve, which gas valve provides gas for burning in a plenum chamber, said control circuit including:

a secondary DC power supply, power switching means controllably coupled to a secondary power control circuit, said secondary power control circuit electrically coupled to said secondary DC power supply, said automatic gas valve and an auxiliary fan, said power switching means providing electreical power from said primary AC power supply to said automatic gas valve and to said thermostat as long as said primary power supply remains uninterruptred, said secondary power control circuit controlling said secondary DC power supply in a manner such that said automatic gas valve first receives power of one polarity followed by said auxiliary fan being energized and thereafter said automatic gas valve receiving power of an opposite polarity whereupon the sequence of automatic gas valve and auxiliary fan operation repeats itself, said power switching means upon detection of an interruption of power from said primary AC power supply providing an electrical connection between said secondary power control circuit, said secondary DC power supply, said automatic gas valve and said auxiliary fan to thereby allow said gas furnace in a power interruption emergency to provide alternate periods of convection and forced air heating.

3. The emergency heating control circuit of claim 2 wherein said secondary power control circuit includes a timing means and a logic circuit, said timing means providing a sequential series of signals to said logic circuit, said logic circuit having outputs that controllably couple said secondary DC power supply to said automatic gas valve and said auxiliary fan.

4. The emergency heating system control circuit of claim 3 wherein said thermostat is connected in series to a high temperature limit switch response to the plenum chamber temperature, said theremostat and high temperature limit switch are controllably connected to said automatic gas valve and said secondary power control circuit by said power switching means to thereby ensure automatic gas valve turn off should there be a secondary power control circuit failure which allows the automatic gas valve to remain open.

5. The emergency heating system control circuit of claim 4 wherein said auxiliary fan is positioned to direct the movement of convection heated air.

6. The emergency heating control circuit of claim 4 in which said secondary DC power supply is a battery.

7. The emergency heating system control circuit of 5, wherein said power switching means includes a relay that is normally energized by said AC power supply, said relay including a trio of switches having a pair of front contacts which pair of front contacts are normally electrically connected respectively to said AC power supply, said thermostat, said high temperature limit switch and said automatic gas valve, said relay trio of swtiches further including a trio of back contacts which become operative when said AC power supply is interrupted and said trio of switches complete circuits over said back contacts respectively to said thermostat, said high temperature limit switch, said secondary power control circuit and said automatic gas valve.

* * * * *